US006443445B1

(12) United States Patent
Bortolotti

(10) Patent No.: US 6,443,445 B1
(45) Date of Patent: Sep. 3, 2002

(54) DEVICE FOR THE FEEDING OF FLAT MATERIALS

(75) Inventor: Giuseppe Bortolotti, Yverdon (CH)

(73) Assignee: Olivetti Tecnost S.p.A., Ivrea (IT)

( * ) Notice: Subject to any disclaimer, the term of this patent is extended or adjusted under 35 U.S.C. 154(b) by 0 days.

(21) Appl. No.: 09/619,608

(22) Filed: Jul. 19, 2000

(30) Foreign Application Priority Data

Aug. 9, 1999 (CH) ..... 1460/99

(51) Int. Cl.[7] ..... B65H 3/06

(52) U.S. Cl. ..... 271/117; 271/118; 271/126; 271/157

(58) Field of Search ..... 271/117, 118, 271/126, 157, 160

(56) References Cited

U.S. PATENT DOCUMENTS 5,201,873 A * 4/1993 Kikuchi et al. ..... 271/117 X
5,853,171 A * 12/1998 Halpenny ..... 271/126
6,042,103 A * 3/2000 Yraceburu et al. ..... 271/118
6,056,285 A * 5/2000 Kikuta et al. ..... 271/118

* cited by examiner

*Primary Examiner*—David H. Bollinger
(74) *Attorney, Agent, or Firm*—Banner & Witcoff, Ltd.

(57) ABSTRACT

A sheet feeding device for printers and other machines comprises a movable support (17) whereon a stack of sheets may be arranged and resiliently urged against selection wheels (19). A retracting mechanism (50) is arranged so as to push back during one phase of a selection cycle the movable support (7) by a predetermined distance which is substantially constant and independent of the thickness of the stack of sheets. The retracting mechanism (50) for this purpose comprises a connecting rod (58) displaced by a cam wheel (66) following a backward and forward movement. The connecting rod (58) bears a pawl (57) cooperating with a ratchet wheel (56) suitable for driving a lever (51) integral with the movable support (17). Additionally an actuating mechanism permits the partial opening of the guiding channel (28) when the sheet arrives in a printing zone (35). Thanks to these characteristics, the movements of parts, and in particular of the movable support (17), may be kept to an optimal and constant minimum, which ensures fast, precise and noiseless operation. Printing of great precision is also obtained.

14 Claims, 5 Drawing Sheets

DEVICE FOR THE FEEDING OF FLAT MATERIALS

BACKGROUND OF THE INVENTION

This invention relates to a device for the feeding of flat materials for processing, such as sheets and envelopes, for machines using these materials, such as printers, comprising a frame and a movable support upon which a stack of said materials may be arranged and from which these materials are extracted one by one during selection cycles by selecting means engaging with a feeding mechanism and suitable for displacing the top material of the stack for feeding it into the machine, elastic means being provided for urging the movable support in the direction of the selecting means.

PRIOR ART

Devices such as these are known wherein the top sheet selection mechanism, upon each selection, requires great movements of parts, the full stroke of which is in relation to the maximum thickness of the stack of sheets that the movable support can accommodate. These great movements of parts, and of the movable support in particular, considerably slow down operation of the feeding device and cause annoying noises and rapid wear.

Another drawback of the known devices lies in the fact that the sheet selected is still being braked by the selection mechanism when it has already been entered in the printer and is being fed by the latter. As a result, there are variations of the paper feed pitch, giving rise to clearly visible defects, especially in high resolution graphics printing.

SUMMARY OF THE INVENTION

The object of this invention is to overcome the drawbacks outlined above; to this end, the invention is characterized in that the device comprises a retracting mechanism adapted in such a way as to push, during at least one phase of a selection cycle, the movable support back against the action of the elastic means by a predetermined distance which is substantially constant and independent of the thickness of the stack of materials, in order to produce a predetermined gap between the top material and the selecting means and of a magnitude such that friction between the top material and the selecting means is eliminated.

Thanks to these characteristics, the movements of the parts, and in particular those of the movable support for the sheets, may be reduced to a minimum during the selection, thus ensuring rapid, precise and silent operation, while lowering wear of the parts to a minimum. With the top sheet being distanced from the selecting means in a precise and controlled way, printing of great precision is obtained even in high resolution graphic printing.

To advantage, the feeding mechanism is adapted in such a way as to actuate both the selecting means and the retracting mechanism. Operation is particularly sure, while the construction remains simple and economical.

According to a preferred embodiment, the retracting mechanism comprises kinematic linkage members linking the driving mechanism with the movable support in such a way that the latter, in said phase, effects a predetermined movement starting from a first position wherein said stack is resting against the selecting means to a second position wherein the top material is removed from the selecting means by said predetermined gap, said movement being substantially constant whatever the position occupied by the movable support member in said first position and whatever the thickness of said stack. These characteristics guarantee great operating precision.

Advantageously the linkage members comprise a ratchet member cooperating actively with an opposing member following a first direction to displace the support member from the first position to the second position and permitting a free relative displacement of the ratchet member in relation to the opposing member following a second direction, opposite the first direction.

In a favourable embodiment, the opposing member is a ratchet wheel coupled in movement with the movable support and the ratchet mechanism is a pawl borne by a part, the displacement of which is controlled by the driving mechanism.

Thanks to these characteristics, the mode of operation is very safe and the number of parts limited. Said part is to advantage a connecting rod adapted for cooperating with a cam put in action by the driving means through the action of a clutching member. Separation of the top sheet from the selecting means can thus be controlled precisely and reliably.

In the known devices, it has often been remarked that the sheet feeding pitch in high resolution printing mode is not absolutely constant, which gives rise to images of poor quality. This drawback was to be ascribed to the fact that the sheet was braked to a varying extent in the guiding channel by the selecting means. In order to overcome this significant drawback, the device according to this invention comprises an actuating mechanism intended to broaden and narrow at least a part of a guiding channel for said materials during a phase of each selection cycle.

Accordingly when the sheet is being printed, the guiding channel may be broadened so that the friction forces are very low during the printing and a highly regular feeding of the sheet may be guaranteed. On the other hand, while the sheet is being fed towards the printing zone the guiding channel is narrowed to permit a very effective guiding of this sheet.

Other advantages will become apparent from the characteristics set down in the adjoining claims and from the description provided below explaining the invention in greater detail with the aid of drawings which represent, schematically and by way of example, one embodiment and variants thereof.

LIST OF FIGURES

DESCRIPTION OF THE PREFERRED EMBODIMENT

Figure 1:
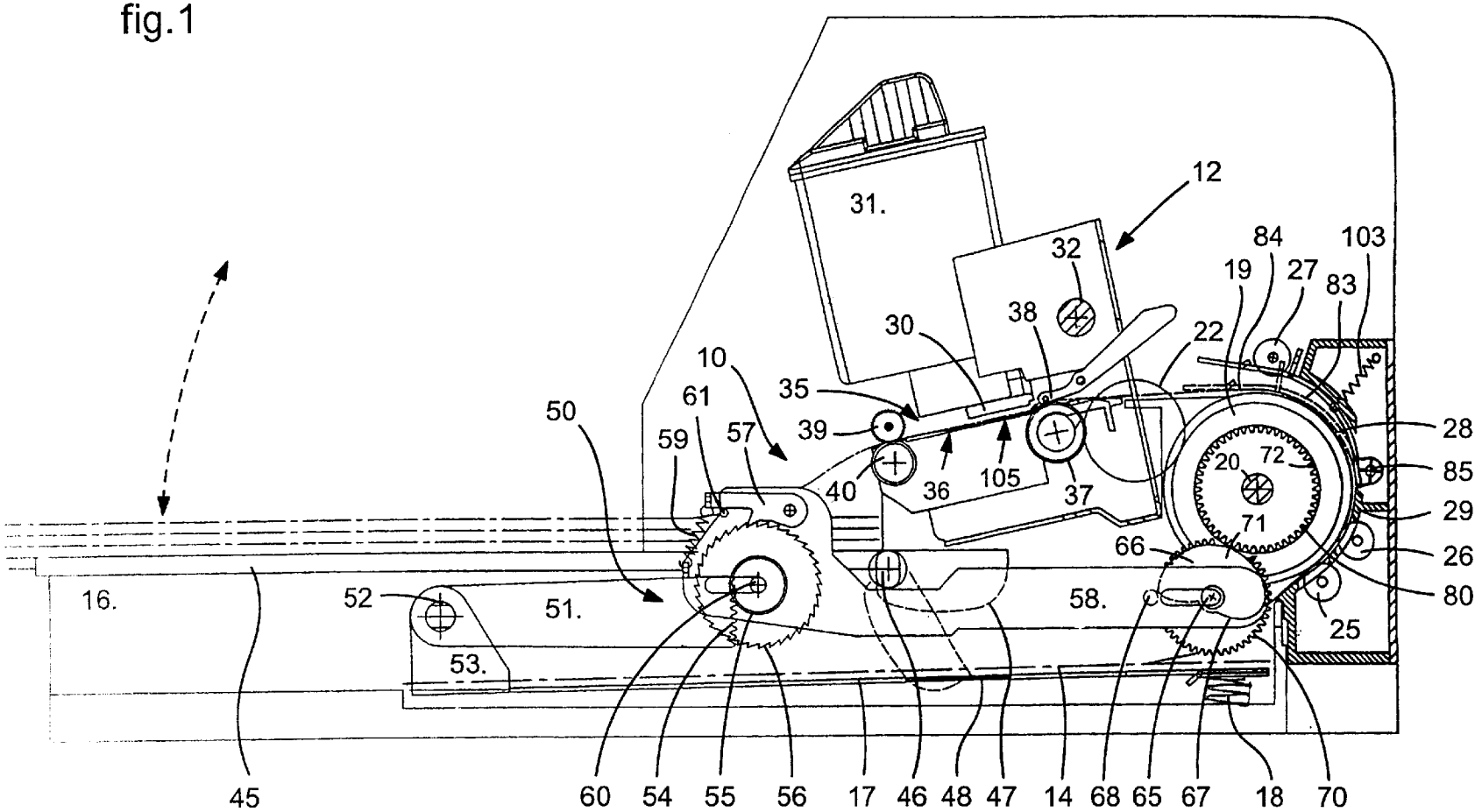
FIG. 1 is a side view of this embodiment.

The feeding device 10 of flat materials for processing is here combined with a printer 12 using sheets 14 or envelopes. Generally speaking, the feeding device 10 may be integrated in the machine that uses the sheets or could also be separate from the latter. In the embodiment illustrated in FIGS. 1 through 3, the feeding device 10 is entirely integrated within the printer. The whole comprises a frame 15. The sheets for printing 14 are stored in a receptacle 16 comprising a movable support 17. Springs 18 urge the movable bottom 17 and the sheets 14 against selection wheels 19.

Figure 2:
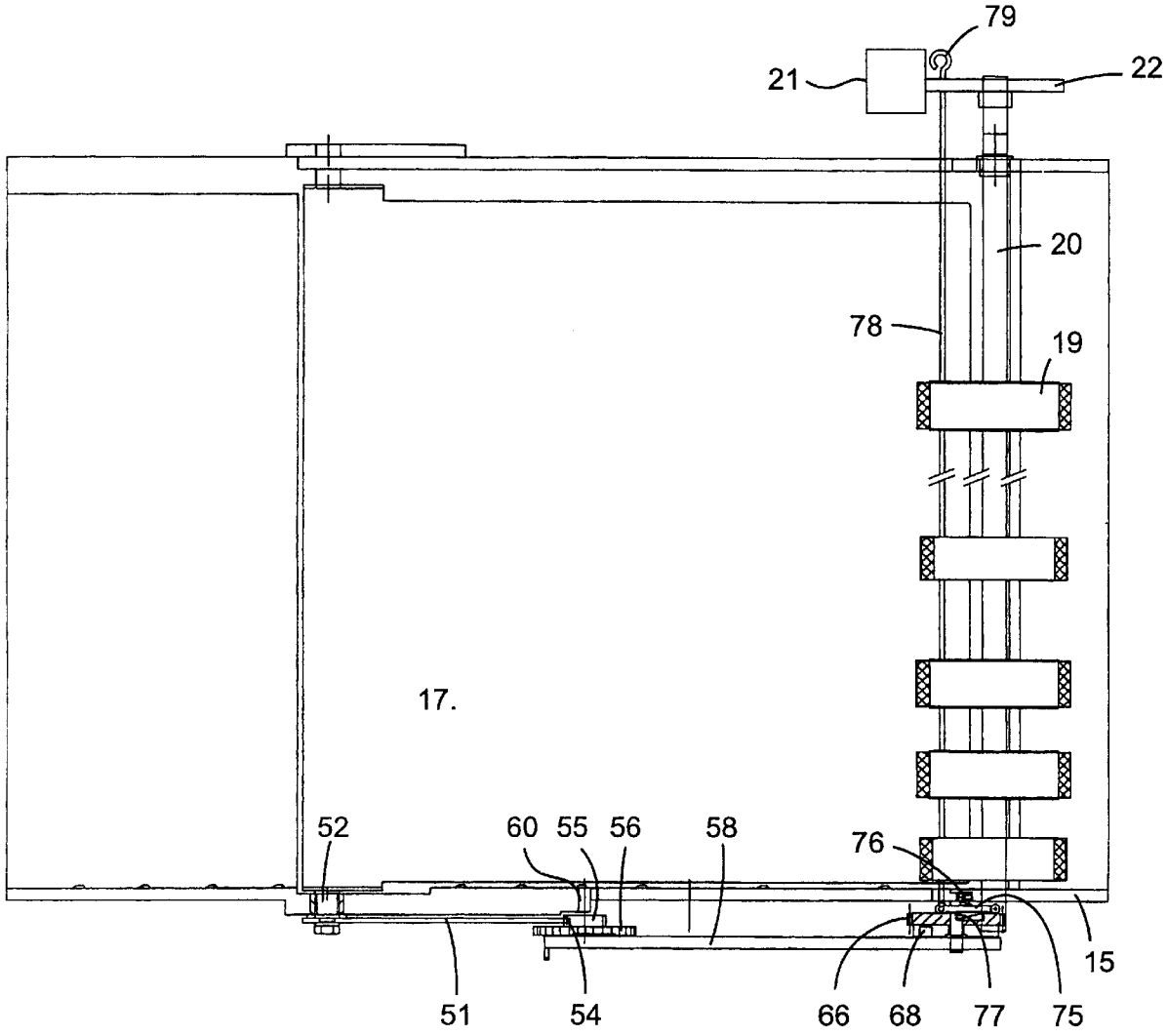
FIG. 2 is a partial plan view of this embodiment.

The latter-named are mounted on a selection shaft 20 and driven in rotation by a motor 21 illustrated schematically in FIG. 2 through a gear train 22. Counter-rotating rollers 25, 26 and 27 mounted freely turning on shafts are arranged along a guiding channel 28 bounded by a wall 29 surrounding the selection wheels 19.

The printer 12 comprises a printing zone 35 with a printhead 30 borne by a carriage 31 which is mounted slidingly on a shaft 32. The printing zone 35 is provided with its own driving device 36 for the sheets 14. This driving device comprises at the entrance to the printing zone a transport roller 37 also driven by the motor 21 through the gear train 22 and cooperating with counter-rotating rollers 38. At the exit of the printing zone, the driving device has sprocket wheels 39 cooperating with rollers 40. The sheets 14 are thus maintained and fed with precision through the printing zone. They are then placed on a receiving tray 45 which is mounted pivotingly on the frame 15 thanks to pins 46. The receiving tray 45 is integral with one or two cam-shaped lateral extensions 47 adapted for cooperating with projecting portions 48 of the movable support 17. Accordingly, when the receiving tray 45 is raised by right-hand rotation in FIG. 1 to load sheets 14 in the receptacle 16, the movable support 17 is lowered through the action of the extensions 47, which permits easy access and loading.

In an original way, the feeding device 10 is provided with a retracting mechanism 50 adapted for pushing back during a phase of the selection cycle the movable support 17 against the action of the springs 18 by a predetermined distance which is substantially constant and independent of the thickness of the stack of sheets 14 arranged on the movable support 17. The mechanism 50 therefore permits an essentially fixed given gap to be obtained between the top sheet and the selection wheels 19 and of which the magnitude is such that friction between the top sheet and the selection wheels is eliminated. This withdrawal distance could, for example, be fixed at between 1 and 8 mm, to advantage between 2 and 5 mm.

With reference to FIG. 1, the retracting mechanism 50 comprises a lever 51 which is integral with the movable support 17. This lever is affixed to a shaft 52 mounted rotatingly on the frame 15 and integral with a part 53 of the movable support 17, extends parallel to the support 17 and possesses a toothing 54 at its free end. This toothing 54 cooperates with a cogwheel 55 belonging to a ratchet wheel 56 mounted rotatingly on the frame 15 and which can be put into left-hand rotation by means of an hinged pawl 57 pivoting about a connecting rod 58 and urged against the ratchet wheel 56 by a spring 59.

The connecting rod 58 is mounted slidingly at one end on a shaft 60 of the ratchet wheel 56 and at the other end on a shaft 65 of a cam wheel 66. The shafts 60 and 65, to this end, traverse the connecting rod 58 through longitudinal slits.

The cam wheel 66 is provided with a cam 67 cooperating with a cam follower 68 integral with the connecting rod 58. This cam follower 68 is urged against the cam 67 thanks to the action of the spring 18 acting on the lever 51 which urges the ratchet wheel 56 into right-hand rotation so as to push the connecting rod 58 to the right in FIG. 1.

The cam wheel 66 is provided with a toothing 70 having a notched sector 71 without toothing. The toothing 70 is suitable for meshing with a cogwheel 72 integral with the selection shaft 20.

The retracting mechanism 50 also comprises a pawl 75 (FIG. 2) mounted rotatingly on the frame 15. This pawl 75 is urged by a spring 76 into a notched recess 77 provided on the rear face of the cam wheel 66. The pawl 75 can be disengaged from the notched recess 77 by means of an actuating pin 78, the free end 79 of which is suitable for cooperating with a part of the carriage 31 when the latter is displaced upwards in FIG. 2.

In the initial position illustrated in FIG. 1, the connecting rod 58 urges the cam wheel 66 into right-hand rotation. However, this cam wheel is held back by the pawl 75 and its notched sector 71 is then in a position facing the cogwheel 72. In this position, the top sheet is withdrawn by a predetermined distance from the selection wheels 19. The latter-named and the driving device 36 may be put into action to effect the printing of a sheet without the top sheet of the stack touching the selection wheels 19.

When a new sheet has to be fed into the printing zone 35, the carriage 31 actuates the pawl 75 following a sheet feeding command. The cam wheel 66 is then freed and, under the action of the connecting rod 58 and the spring 18, effects a rapid right-hand rotation until its toothing 70 engages with that of the cogwheel 72. To avoid this sudden rotation from causing too great a sound effect, the cogwheel 72 is provided on its flat outer surface with a neoprene disk 80 which touches the toothing 70 laterally and which, by flattening out, dampens the impact of the toothing 70 on the toothing of the cogwheel 72.

The cam wheel 66 is then driven into right-hand rotation and the connecting rod 58 moves to the right in FIG. 1, as a result of which the ratchet wheel 56 can turn in a right-hand direction. At the end of the stroke of the connecting rod 58, when the cam wheel 66 has turned through an angle of roughly 90°, the pawl 57 in abutment against a pin 61 is away from the toothing of the ratchet wheel 56. The lever 51 and the movable support 17 can now turn in a left-hand direction about the shaft 52 under the effect of the spring 18 until the top sheet comes into contact with the selection wheels 19. The latter in this way drive the sheets in the guiding channel 28 to the transport roller 37 of the printing zone 35. The movable support 17 can in this way be removed from the selection wheels 19.

The connecting rod 58 is then pushed by the cam 67 to the left, with the result that the pawl 57 turns the ratchet wheel 56 through a predetermined angle in the left-hand direction. The latter drives the lever 51 and the movable support through a given angle in the right-hand direction so as to obtain the predetermined distance between the top sheet 14 and the selection wheels 19. This therefore remains substantially constant within the limits of precision determined by the angular rotation between two teeth of the ratchet wheel 56. When the stack of sheets 14 on the movable support 17 becomes thinner, the ratchet wheel 56 cooperates with the pawl 57 through teeth located more and more to the left. The tooth of the ratchet wheel 56 which cooperates with the pawl 57 is determined when the connecting rod 58 is in its right-hand position.

When it is wished to feed sheets on the movable support 17 and the receiving tray 45 is pivoted, the movable support 17 is lowered by the lateral extensions 47. The ratchet wheel 56 is then driven by the lever 51 following a left-hand direction of rotation, whereas the movable support 17 is retained in the low position by the pawl 57. During the next selection and movement of the connecting rod 58 to the right, the movable support 17 is freed and urges the top sheet against the selection wheels 19.

Figure 3C:
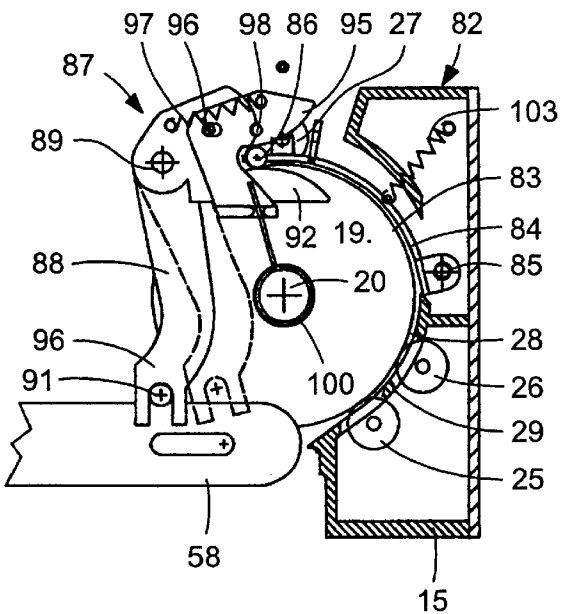
FIGS. 3A, 3B and 3C are side views of a part in three different working positions.
Figure 3B:
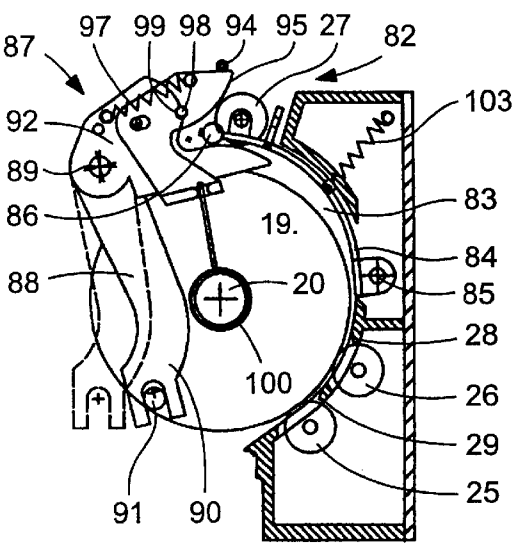
Figure 3A:
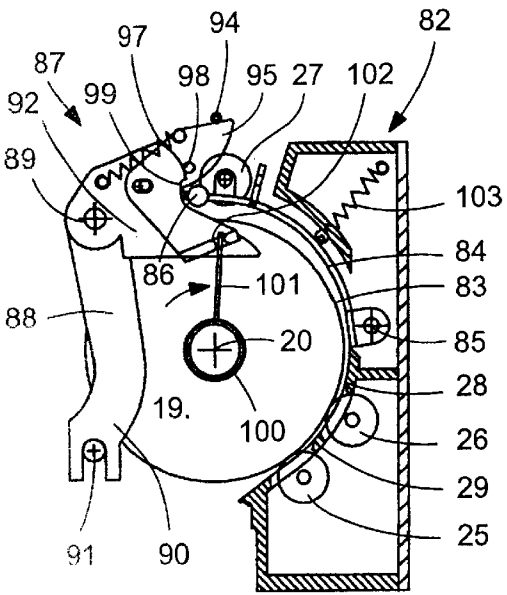

With reference to FIGS. 3A, 3B and 3C, the feeding device 10 can be combined with an actuating mechanism 82 adapted for broadening and narrowing the rear part 83 of the guiding channel 28. A rear movable wall 84 of the outer wall 29 of the guiding channel 28 is, to this end, mounted by means of a pin 85 on the frame 15, see also the two positions illustrated in FIG. 1. At its free end, it disposes of a bar 86 adapted for cooperating with a ratchet and pawl mechanism 87. The latter disposes of a rocker 88 mounted on the frame 15 by way of a pin 89 and comprising a fork 90 engaged on a rod 91 integral with the connecting rod 58. The rocker 88 possesses a lip 92 adapted for cooperating with the bar 86.

A pawl 95 is mounted by way of a sliding pivot 96 on the lip 92. A spring 97 stretched between the lip 92 and the pawl 95 urges the latter-named in the left-hand direction of rotation in FIG. 3A against a fixed abutment 94. The pawl 95 is provided with a rod 98 adapted for engaging in a notch 99 provided on the lip 92 so as to retain the pawl 95 in the closed position (FIG. 3C).

The actuating mechanism 82 also possesses a spring 100, called "torpedo", wound in a right-hand spiral on the selection shaft 20 in such a way that a right-hand rotation of the latter-named renders the spiral integral with the shaft 20, whereas a rotation in the opposite direction does not drive this spring into rotation. This spring 100 possesses a free portion 101 engaged in a slit 102 of the pawl 95. When the selection shaft 20 turns towards the rear in a right-hand direction, the pawl 95 can thus be opened by disengaging the rod 98 from the notch 99. The rear wall 84, urged by a spring 103, can thus turn about the pin 85 to open the rear part 83 of the channel 28 (FIG. 3A). The closing of this rear part 83 of the channel is commanded by an out-and-return movement of the rocker 88 and of the connecting rod 58. In the outward movement to the right (FIG. 3B), the rod 98 of the pawl 95 engages in the notch 99 of the rocker and in the return movement of the rocker 88, the pawl 95 closes this rear part 83 of the channel to ensure precise guiding of the sheet towards the printing zone 35.

It should be observed that the backward rotation in a right-hand direction of the selection shaft is commanded by the passage of the sheet in front of a mechanical or opto-electronic sensor 105 arranged in the printing zone 10 mm downstream of the rollers 37, 38.

With reference to FIG. 1 and to FIGS. 3A, 3B, 3C, a selection and printing cycle comprises the following steps:

a) On completion of the printing of a sheet, the position is that illustrated in FIG. 3A with the rear part of the channel open, the cam wheel 66 being retained by the pawl 75.

b) Following a selection command, the carriage 31 actuates the pawl 75 and frees the cam wheel 66 which meshes with the cogwheel 72 turning in a left-hand direction. The connecting rod 58 moves to the right and permits rising of the movable support 17. After a rotation of roughly 90°, the pawl 57 is freed of the ratchet wheel 56 and the movable support 17 freely urges the top sheet against the selection wheels 19 to drive it into the guiding channel 28. At the same time, the rocker 88 is turned in a left-hand direction and the rod 98 engages in the notch 99 (FIG. 3B).

c) When the cam wheel 66 turns between 90 and 180°, the connecting rod 58 is pushed back to the left, as a result of which the support 17 is pushed by a given angle in a right-hand direction removing the top sheet by a predetermined angle away from the selection wheels 19.

At the same time, the rocker 88 turns in a right-hand direction and closes the rear part 83 of the guiding channel to obtain a precise guiding of the sheet towards the printing zone 35 (FIG. 3C).

After a 360° rotation of the cam wheel 66, the pawl 75 blocks the latter in the position in which the notched sector 71 is facing the cogwheel 72.

d) When the sheet passes in front of the sensor 105 located 10 mm downstream of the rollers 37, 38, the direction of rotation of selection shaft 20 is inverted for a short time, corresponding to a retraction by about 5 mm of the sheet. The torpedo spring 100 then opens the pawl 95 and the rear wall 84 (FIG. 3A). The sheet is then fed by the rollers 37 to 40 of the printing zone 35 and by the selection wheels 19 cooperating with the counter-rotating rollers 25, 26 located at the start of the guiding channel. Advantageously, the peripheral speed of the selection wheels is very slightly greater than that of the rollers 37 to 40 so that the sheet does not touch the selection wheels in the rear part 83 of the guiding channel and may be moved very uniformly and without jerks, ensuring a very precise printing with an absolutely constant line feed.

It should be observed that selection of the paper is made very quickly, corresponding to one half-turn of the cam wheel 66. Accordingly further sheets cannot be driven in the wake of the top sheet. When the latter arrives in the printing zone, the selection has been completed for a considerable time. There is therefore no jerking during printing.

The selection of the sheet and the closing of the channel 29 are commanded by an outward-and-return movement of the connecting rod 58. The opening of channel 29 is obtained by the brief inversion of the direction of rotation of the selection shaft 20.

Figure 5:
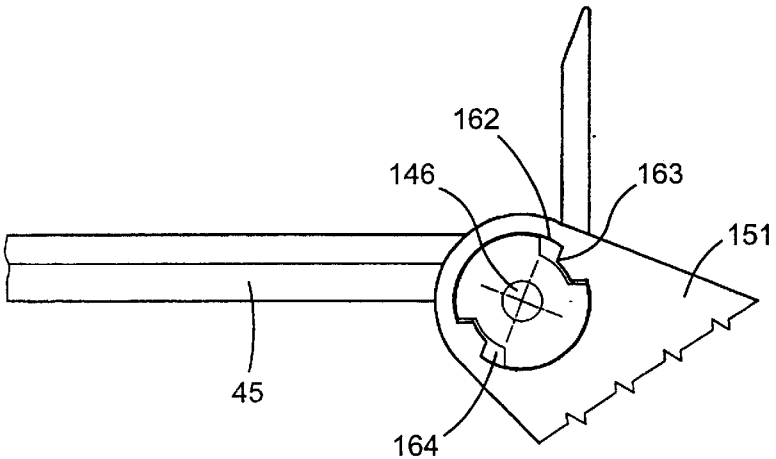
FIG. 5 is a detailed view of this variant.
Figure 4:
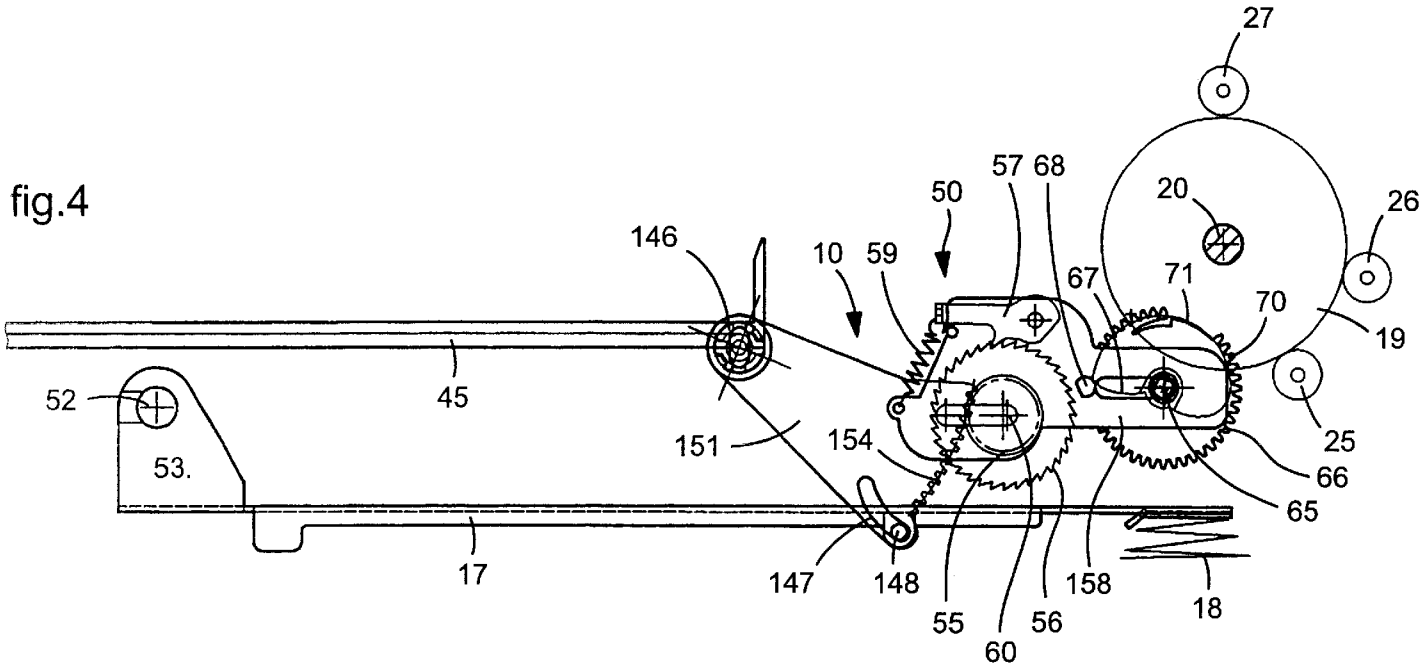
FIG. 4 shows a partial side view of a variant.

$2^{nd}$ embodiment—The variant illustrated in FIGS. 4 and 5 is similar to the embodiment in FIG. 1, apart from the shape of the connecting rod 158 and the linking of the cogwheel 55 with the movable support 17. Items that are identical or similar are therefore designated with identical reference numerals.

In this variant, the connecting rod 158 is shorter. It also bears the pawl 57 and the cam follower 68 cooperating with the cam 67. The receiving tray 45 is mounted pivotingly by way of a pin 146, whereon a toothed sector 151 is also mounted pivotingly. The toothing 154 of the latter meshes with the cogwheel 55 integral with the ratchet wheel 56. The toothed sector 151 possesses a curved slit 147 cooperating with a rod 148 integral with the movable support 17. Accordingly, when the ratchet wheel 56 is turned through a given angle following a left-hand direction, the toothed sector 151 makes the movable support 17 pivot downwards through a given angle about the pin 52. The shape of the curved slit 147 is chosen in such a way that the relationship between the angles of pivoting of the toothed sector 151 and of the movable support 17 is substantially constant whatever the position of the latter, and therefore whatever the thickness of the stack of sheets upon the latter-named. The mechanism therefore also permits a given, essentially fixed gap to be obtained between the top sheet and the selection wheels. During its pivoting about the pin 146, the toothed sector 151 does not drive the receiving tray 45. In point of fact, the toothed sector 151 comprises a pivoting bore 162 surrounding the pin 146 of the receiving tray 45. This bore is provided with two projecting portions 163 penetrating into two hollowed portions 164 shaped so as to permit a rotation action between the toothed sector 151 and the receiving tray 45 (FIG. 5). However, when the receiving tray 45 is raised, the toothed sector 151 can be driven, when the movable support 17 is in a high position, to displace the latter downwards and permit the loading of a stack of blank sheets.

According to a variant not depicted, the pawl 57 is mounted on a lever turning about the shaft 60 of the ratchet wheel 56. This lever may in this way be driven by a connecting rod, one end of which is linked to a wheel linked in turn by a clutching member to the selection wheels 79.

Figure 6:
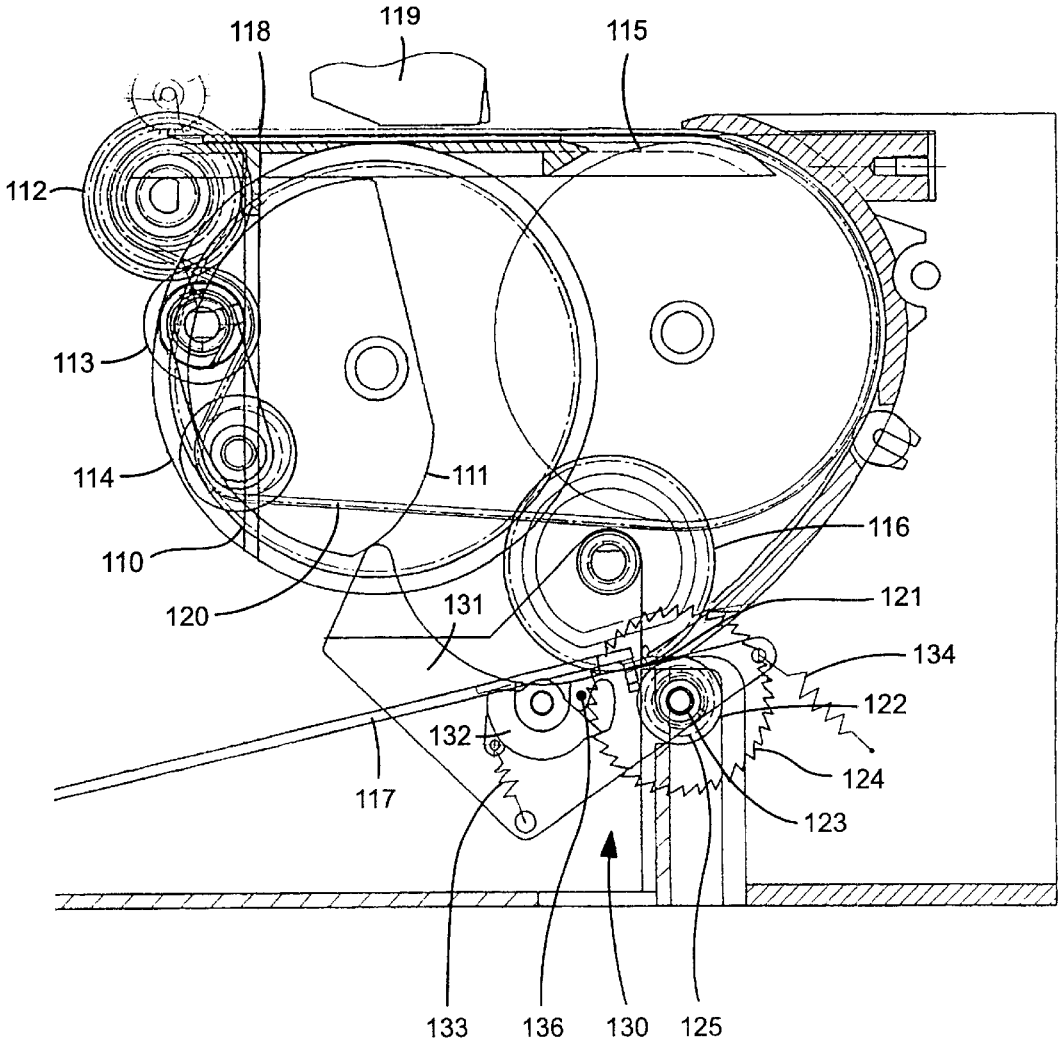
FIG. 6 shows a partial side view of another variant.

In another variant illustrated in FIG. 6, a cam wheel 110 integral with a cam 111 and pulleys 112, 113, 114 and 115 are driven by a motor not depicted. The cam wheel 110 turns selection wheels 116 for the top sheet of a stack arranged on a pivoting movable support 117. The sheet selected is transported to the printing zone 118 comprising a printhead 119 by means of a driving belt 120 tightened about the rollers 112 to 115.

The movable support 117 is pulled upwards against the selection wheels 116 by the traction force of a wire 121 attached to the bottom part of the movable support 117 and which is wound on a hub 122 pivoting about a shaft 123.

The hub 122 is integral with a ratchet wheel 124 and bears a helical spring 125 arranged so as to make the hub 122 pivot in a right-hand direction, the effect of which is to pull the movable support 117 upwards.

A retracting mechanism 130 adapted for pushing back the movable support 117 is made of a lever 131 mounted pivotingly on the shaft 123 and cooperating with the cam 111 integral with the wheel 110 under the action of a spring 134. The lever 131 bears a pawl 132 meshing in the ratchet wheel 124 under the action of a spring 133. In a selection cycle, the mechanism 130 actuated by the cam 111 makes the ratchet wheel 124 pivot through a given angle, which allows the movable support 117 to move away by a predetermined distance from the selection wheels 116, whatever the thickness of the stack of sheets. It should be noted that the pawl 132 rests against a fixed abutment 136, when the lever 131 comes towards its maximal position of right-hand rotation so that it disengages from the teeth of the ratchet wheel 124 and the movable support 117 and the sheets thereon are urged by the helical spring 125 against the selection wheels 116. When the lever 131 turns in a left-hand direction under the action of the cam 111, the pawl 132 meshes again between the teeth of the ratchet wheel 124, which it turns through a substantially constant angle to lower the movable support by a predetermined distance in relation to the selection wheels 116.

It is understood that the embodiments described above are in no way restrictive and all changes desired may be made thereto within the scope as defined in claim 1. In particular, the kinematic linkage members linking the feeding mechanism with the movable support may be of any other kind, such as for example a ratchet mechanism, in the form of a pawl, borne by a part linked to a movable element of a driving mechanism, respectively to the movable support adapted for cooperating with an opposite member in the form of a rack linked to the movable support, respectively to a movable element of the feeding mechanism. The actuating mechanism 82 may be constructed completely differently, for instance providing the full opening of the entire guiding channel. This opening could be obtained by a mechanism very different from that of the helical spring, for example by means of an electromagnet-based operation.

What is claimed is:

1. Feeding device for flat materials for processing, such as sheets and envelopes, for machines using these materials, such as printers, comprising a frame and a movable support whereon a stack of said materials may be arranged and from which these materials are extracted one by one during selection cycles by selecting means meshing with a driving mechanism and suitable for displacing the top material of the stack to feed said top material into the machine, elastic means being provided for urging the movable support in the direction of the selecting means, said feeding device further comprising a retracting mechanism arranged so as to push back during at least one phase of a selection cycle the movable support against the action of the elastic means by a predetermined distance which is substantially constant and independent of the thickness of the stack of materials, so as to obtain a predetermined gap between the top material and the selecting means and of a magnitude such that friction between the top material and the selecting means is eliminated, wherein said retracting mechanism comprises kinematic linkage members linking the driving mechanism with said movable support so that the latter, in said phase, effects a predetermined movement starting from a first position wherein said stack is resting against said selecting means to a second position wherein the top material is removed from said selecting means by said predetermined gap, said movement being substantially constant whether the position occupied by said movable support member in said first position and whatever the thickness of said stack.

2. Device according to claim 1, wherein said linkage members comprise a ratchet mechanism cooperating actively with an opposing member following a first direction to displace said support member from the first position to the second position and permitting a free relative displacement of said ratchet mechanism in relation to said opposing member following a second direction, opposite said first direction.

3. Device according to claim 2, wherein the opposing member is a ratchet wheel coupled in movement with said movable support and in that said ratchet mechanism is a pawl borne by a part, the displacement of which is controlled by said driving mechanism.

4. Device according to claim 3, wherein said ratchet wheel is integral with a wheel meshing with a toothing arranged so as to displace said movable support.

5. Device according to claim 2, wherein the opposing member is a rack linked to said movable support, respectively to a movable element of said driving mechanism, and wherein the ratchet mechanism is a pawl borne by a part linked to a movable element of said driving mechanism, respectively to said movable support.

6. Device according to claim 3, wherein said part is a connecting rod adapted for cooperating with a cam put in action by said driving mechanism through the action of a clutching member.

7. Device according to claim 3, wherein said ratchet wheel is integral with a hub upon which is wound a wire, the free end of which is attached to said movable support and in that said retracting mechanism comprises a resilient element adapted for urging said hub following a direction of rotation such that said movable support is displaced in the direction of said selecting means.

8. Device according to claim 7, wherein said part bearing said pawl is a lever mounted rotatingly about the axis of said ratchet wheel and having a portion urged elastically against a cam put in rotation by an element of said driving mechanism.

9. Device according to claim 3, wherein said part bearing said pawl is mounted rotatingly about said axis of said ratchet wheel and has one end linked by means of a clutching device to a wheel of said driving mechanism.

10. Device according to claim 3, wherein said narrowing of said part of the guiding channel is obtained by a backward and forward movement of said part bearing the pawl and driving in rotation a rocker, of which one end is adapted for cooperating with said rear part through a pawl element, and in that the opening of said part of the guiding channel is obtained by the action of a helical spring mounted about a selection shaft of said selecting means to open said pawl element.

11. Device according to claim 1, wherein said device further comprises an actuating mechanism adapted for broadening and narrowing at least one part of a guiding channel for said materials during a phase of such selection cycle.

12. Device according to claim 11, wherein said actuating mechanism is arranged so as make the rear part of a wall of the guiding channel pivot.

13. Device according to claim 11, wherein said actuating mechanism is driven by said driving mechanism and/or said retracting mechanism.

14. Device according to claim 1, wherein said device further comprises a movable tray for the processed flat materials mounted pivotingly at least partially above said movable support, in that this movable tray is provided with at least one portion adapted for pushing back said movable support to a loading position against the action of the elastic means during a rotation of the movable tray, and in that the retracting mechanism is arranged so as to retain said movable support in said loading position.

* * * * *